US006107868A

United States Patent [19]

Diniz et al.

[11] Patent Number: 6,107,868

[45] Date of Patent: Aug. 22, 2000

[54] TEMPERATURE, SUPPLY AND PROCESS-INSENSITIVE CMOS REFERENCE STRUCTURES

[75] Inventors: George F. Diniz, Liberty; Ronald B. Gray, III, Greensboro, both of N.C.

[73] Assignee: Analog Devices, Inc., Norwood, Mass.

[21] Appl. No.: 09/132,374

[22] Filed: Aug. 11, 1998

[51] Int. Cl.[7] ..... G05F 1/10

[52] U.S. Cl. ..... 327/543; 327/512

[58] Field of Search ..... 323/312, 313, 323/314, 315, 316; 327/378, 513, 538, 539, 543

[56] References Cited

U.S. PATENT DOCUMENTS

| | | | |
|---|---|---|---|
| 4,789,819 | 12/1988 | Nelson | 323/314 |
| 5,349,286 | 9/1994 | Mrrshall et al. | 323/315 |
| 5,798,637 | 8/1998 | Kim et al. | 323/313 |

OTHER PUBLICATIONS

Gray, Paul R., et al., *Analysis and Design of Analog Integrated Circuits*, John Wiley and Son, third edition, 1993, New York, pp. 270, 271 and 322–328.

Tsividis, Yannis, *Operation and Modeling of the MOS Transistor*, McGraw Hill, 1987, New York, p. 148–149.

*Primary Examiner*—Jeffrey Zweizig

*Attorney, Agent, or Firm*—Koppel & Jacobs

[57] ABSTRACT

CMOS reference structures (e.g., voltage, current and resistance structures) are provided that are substantially insensitive to temperature, supply voltages and track fabrication processes. The structures include a $V_t$-referenced source, a sensor and a summer. The source generates a source voltage and a feed-forward current that may have an error term and the sensor generates a feedback current that has a correction term that substantially offsets the error to stabilize a sum current. In different structure embodiments, voltage, current and resistance references are responsive to the stabilized sum current. The source, sensor and summer are preferably realized with MOSFETs whose channel width-to-length ratios are chosen to enhance the temperature insensitivity of the references.

23 Claims, 4 Drawing Sheets

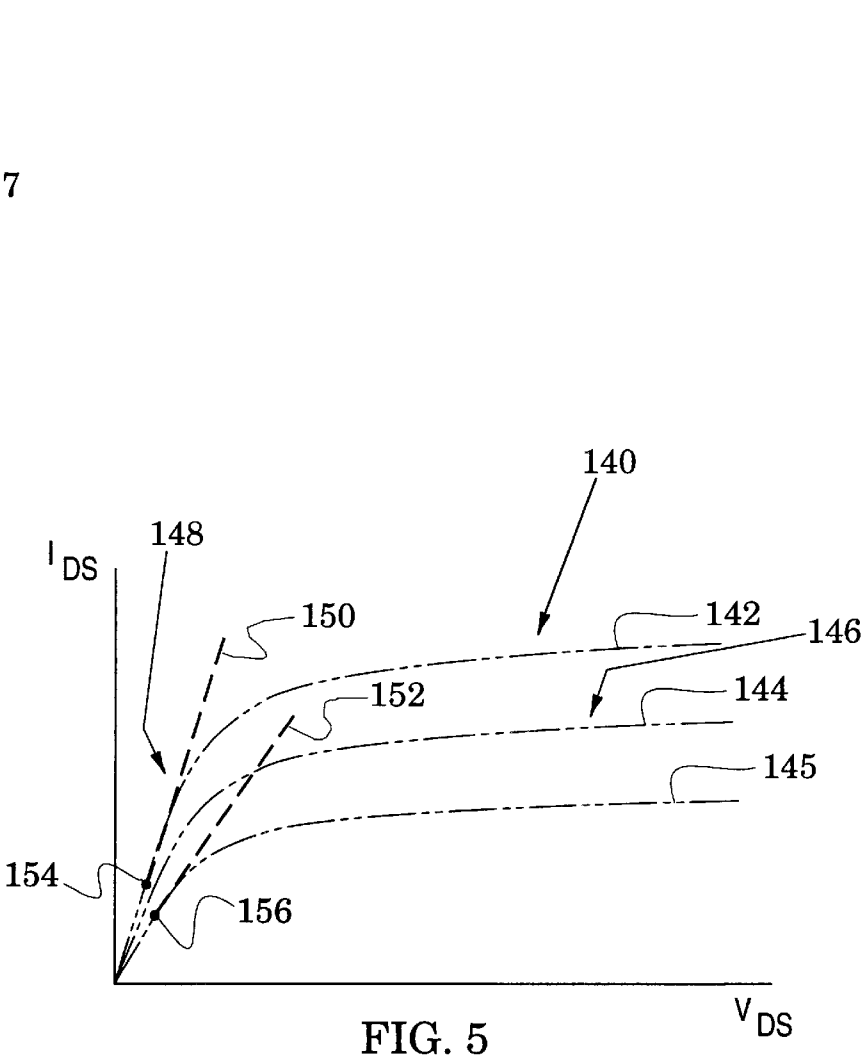
FIG. 5
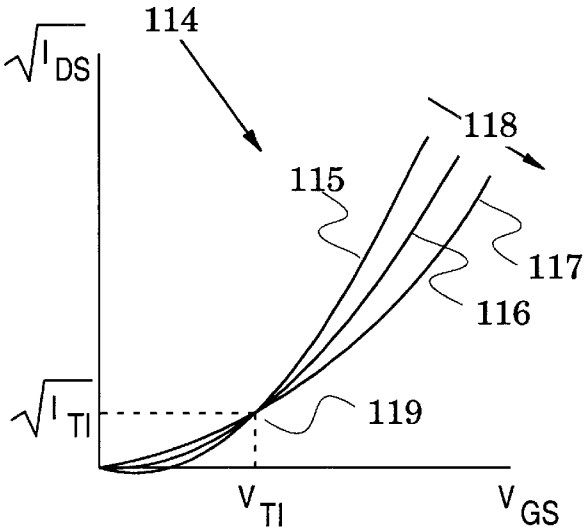
FIG. 4B
FIG. 4A

TEMPERATURE, SUPPLY AND PROCESS-INSENSITIVE CMOS REFERENCE STRUCTURES

BACKGROUND OF THE INVENTION

1. Field of the Invention

The present invention relates generally to electronic current and voltage references.

2. Description of the Related Art

FIG. 1 shows a conventional current source 20 which is especially suited for use in complementary metal-oxide semiconductor (CMOS) integrated circuits. The reference 20 has an n-channel metal-oxide field-effect transistor (NMOSFET) that is arranged as a "diode-connected" transistor 22. The drain of this transistor is coupled to a supply voltage $V_{DD}$ through a drain resistor 24 and its gate is coupled to the gate of an output NMOSFET 26. The sources of both transistors are connected to ground and and the drain of the transistor 26 serves as a current port 28.

In operation of the current source 20, a reference current 30 is set by the expression $\{V_{DD}-V_{DS22(sat)}\}/R_{24}$ in which $V_{DS22(sat)}$ is the saturation voltage of transistor 22 and $R_{24}$ is the resistance of the drain resistor 24. Because of the circuit structure, transistors 22 and 26 have the same gate-to-source voltage $V_{GS}$. If they have the same physical layout and are proximate to each other in an integrated circuit, they have substantially the same operating characteristics so that their identical $V_{GS}$ voltages cause an output current 32 to be substantially equal to the reference current 30 (the output transistor 26 has a finite output resistance $r_o$ so that the output current 32 will vary somewhat with the drain-to-source voltage $V_{DS}$ across this transistor).

The reference current 30 appears to be reflected in the output and, accordingly, the current source 20 is typically referred to as a "current mirror". The output current 32 of the current mirror 20 is substantially proportional to the supply voltage $V_{DD}$ and is generally sensitive to temperature.

Virtually all references are based on a voltage standard and reduced sensitivity to supply voltage has generally been obtained by replacing it with a different standard. For example, the conventional biasing source 40 of FIG. 2 is typically referred to as a $V_t$-referenced source because its voltage standard is the MOSFET threshold voltage $V_t$ (threshold voltage being that $V_{GS}$ voltage that initiates channel inversion in a MOSFET).

In the current source 40, a resistor 42 is coupled between the gate and source of an NMOSFET 44. The transistor 44 is coupled to $V_{DD}$ through a PMOSFET 46 and the resistor 42 is coupled to $V_{DD}$ through an NMOSFET 48 and a diode-connected PMOSFET 49. The gate of transistor 48 is connected to the drains of transistors 44 and 46 and transistors 46 and 49 are gate-coupled. An output PMOSFET 50 is gate-coupled to transistors 46 and 49. The drain of transistor 50 forms a current port 52 and the source of the transistor 48 forms a voltage port 54.

In operation of the reference 40, transistors 46 and 49 form a first current mirror 60 that is similar to the current mirror of FIG. 1 and transistors 49 and 50 form a second current mirror 62. Because of the current mirror 60, the reference current 64 and the current 66 through transistors 44 and 48 are substantially equal. In addition, the reference current 66 through resistor 42 sets the $V_{GS}$ voltage of transistor 44. Combining this relationship with a well-known expression for $V_{GS}$ (e.g., see Gray, Paul R., et al., Analysis and Design of Analog Integrated Circuits, John Wiley and Son, third edition, 1993, New York, p. 64) yields $$IR_{42} = V_{GS} = V_t + \sqrt{\frac{2I}{\mu C_{ox}\frac{W}{L}}} \tag{1}$$

in which I represents the currents 64 and 66, $R_{42}$ is the resistance of resistor 42, $\mu$ is the channel carrier mobility of transistor 44, $C_{ox}$ is gate oxide capacitance per unit area of transistor 44 and W/L is the channel width-to-length ratio of transistor 44.

If the ratio W/L is large, the root term in equation (1) can be neglected which leaves $V_{GS}$ equal to $V_t$. Because the voltage across the resistor 42 is then substantially $V_t$, the reference current 66 is approximately $V_t/R_{42}$ and the current mirrors 60 and 62 force the current 64 and an output current 70 to also approximate $V_t/R_{42}$. Because the voltage at the voltage port 54 is that across the resistor 42, it is substantially $V_t$.

The current source 40 is arranged to be a self-biasing structure and such structures typically exhibit an undesired zero-current operating point in addition to the intended operating point. The current source 60 forces the currents 64 and 66 to be equal while the connection of resistor 42 to the gate of transistor 44 forces the gate-to-source voltage $V_{GS}$ of transistor 44 to equal the current-induced voltage across the resistor.

There are two places where both of these currents and voltages are equal. One is the intended operating point described above and the other is at a zero-current state. If some current initially flows in the current source 40, it will drive itself to the intended operating point. To insure that the current source 40 is driven to this stable operating point, therefore, a startup circuit 72 is arranged to inject a starting current into the structure of the reference 40.

As shown above, the current source 40 provides a current 70 that approximates $V_t/R_{42}$. Therefore, in contrast to the current 32 of the current source 20 of FIG. 1, this current is substantially independent of supply voltage. Unfortunately, the threshold voltage $V_t$ is temperature sensitive and the resistance of the resistor 42 is typically temperature sensitive so that the output current 70 changes over temperature.

In order to remove this temperature sensitivity, other conventional references are arranged to oppose the negative temperature coefficient of the threshold voltage $V_t$ with the positive temperature coefficient of the base-emitter voltage $V_{BE}$ of a bipolar transistor. Because $V_{BE}$ exhibits a greater temperature coefficient, these reference circuits typically multiply $V_t$ by a constant K before summing it with $V_{BE}$ to generate a temperature insensitive voltage reference $V_R$.

In a semiconductor transistor, the base-emitter voltage is a function of the semiconductor's band-gap voltage $V_{GO}$ at zero degrees Kelvin and, as a consequence, an expression for $V_R$ generally includes the band-gap voltage term $V_{GO}$. Accordingly, these references are typically referred to as "band-gap references".

Although band-gap references can be essentially temperature insensitive, they are generally sensitive to variations in fabrication processes. If the circuits of an integrated circuit respond in a similar manner to process variations, this correlation can be used to reduce the the integrated circuit's process sensitivity. This reduction is difficult to realize with band-gap references because the process sensitivity of $V_{BE}$ lacks the necessary correlation to the process sensitivity of CMOS circuits.

Conventional references are therefore generally sensitive to at least one of the parameters of supply voltage, temperature and fabrication processes.

SUMMARY OF THE INVENTION

The present invention is directed to CMOS reference structures (e.g., voltage, current and resistance structures) that are substantially insensitive to temperature, supply voltages and tracks fabrication processes.

These goals are realized with a reference system that includes a $V_t$-referenced source, a sensor and a summer. The source generates a source voltage and a feed-forward current that has a first response to changes in the source voltage, the sensor generates a second response to the changes that substantially offsets the first response and the summer sums the feed-forward current and the feedback current into a sum current and generates a reference voltage that is responsive to the sum current.

Thus, changes in the feed-forward current are corrected by changes in the feedback current so that the sum current and the reference voltage are substantially constant.

In a system embodiment, a current transistor is coupled to the reference voltage and biased in its saturation region to form a reference current. In another system embodiment, the current transistor is biased in its triode region to form a reference resistance.

In embodiments of the invention, the source, sensor and summer are realized with metal-oxide field-effect transistors whose channel width-to-length ratios are chosen to enhance the temperature insensitivity of the references.

The novel features of the invention are set forth with particularity in the appended claims. The invention will be best understood from the following description when read in conjunction with the accompanying drawings.

BRIEF DESCRIPTION OF THE DRAWINGS

FIGS. 4A and 4B respectively illustrate an exemplary diode-connected MOSFET and a graph of the MOSFET's current and voltage as a function of temperature;

FIG. 5 is a graph that illustrates voltage and current in a current transistor of the reference system of FIG. 3.

DETAILED DESCRIPTION OF THE PREFERRED EMBODIMENTS

Figure 3:
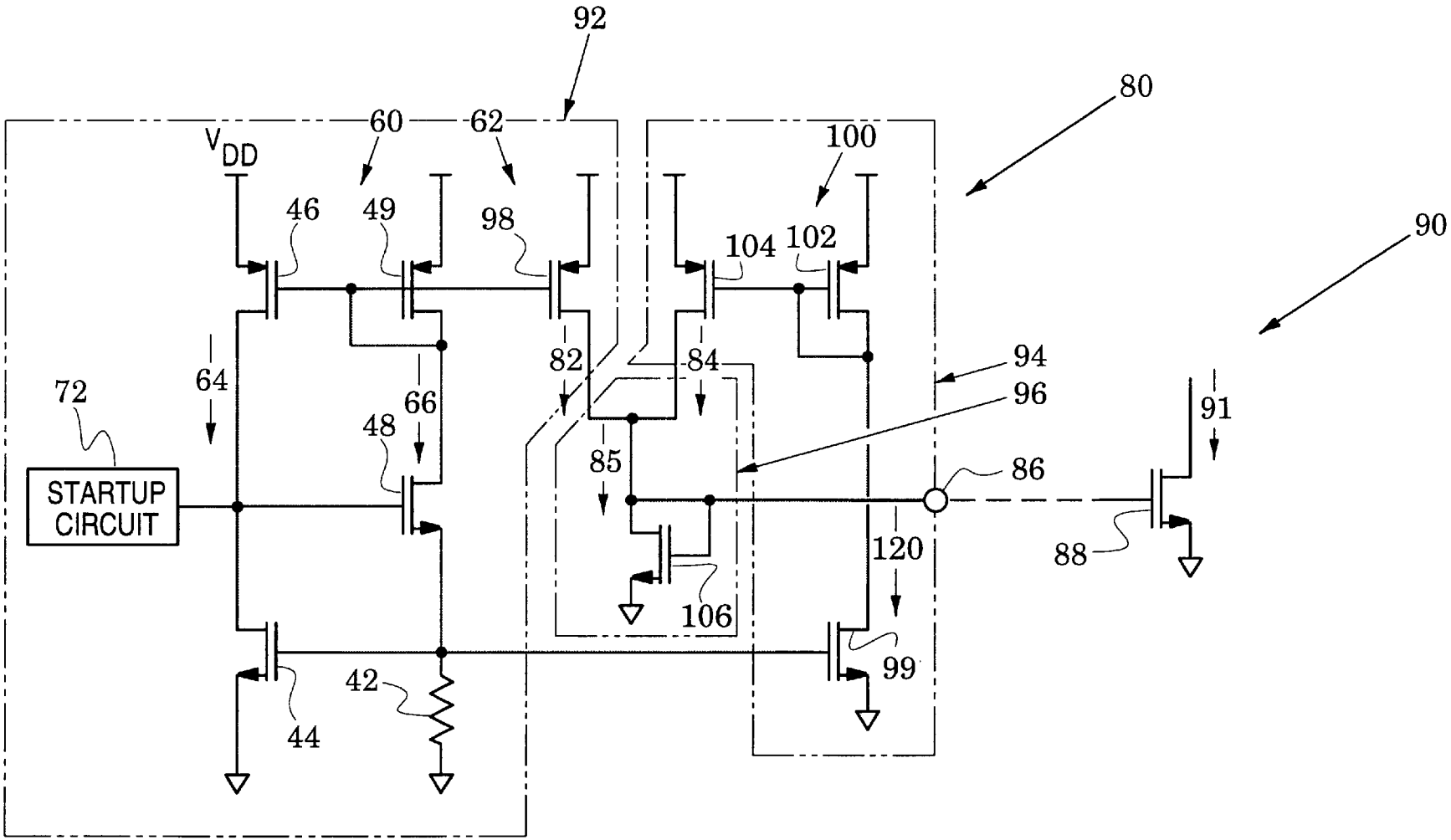
FIG. 3 is a schematic diagram of a reference system of the present invention.

FIG. 3 illustrates a CMOS reference system 80 that offsets changes in a feed-forward current 82 with changes in a feedback current 84 so as to generate a sum current 85 and a reference voltage at an output port 86 that are substantially insensitive to temperature, power-supply and fabrication-process variations.

By supplementing the system 80 with an current transistor 88, a reference system 90 is formed that supplies a reference current 91 that is also substantially insensitive to these variations. Alternatively, the reference system 90 can be converted (by adjusting the operating voltage across the current transistor 88) to provide a reference resistance that is substantially insensitive to temperature, power-supply and fabrication process variations.

In particular, the reference system 80 includes a $V_t$-referenced source 92, a sensor 94 and a summer 96. The source 92 is similar to the $V_t$-referenced source 40 of FIG. 2 with like elements indicated by like reference numbers. However, the output transistor 50 of FIG. 2 has been replaced in the source 92 with a transistor 98 whose channel width-to-length ratio W/L has been altered in a manner that will be described below.

In the embodiment of FIG. 3, the sensor 94 is formed with a sense NMOSFET 99 and a current mirror 100 that includes a diode-coupled PMOSFET 102 an a PMOSFET 104. Transistors 44 and 99 are gate-coupled, transistors 102 and 104 are gate-coupled and transistors 99 and 102 are drain-coupled.

The summer 96 is a diode-coupled NMOSFET 106 whose drain receives and sums the feed-forward current 82 and the feedback current 84 to form the sum current 85. In response to the sum current 85 in its drain, the transistor 106 generates a reference voltage at the output port 86.

The $V_t$-referenced source 92 generates a source voltage across the resistor 42 and a source current that is used as the feed-forward current 82. The sensor 94 generates the feedback current 84 in response to the source voltage. Temperature-induced variations in the resistor 42 cause the source voltage to change. In response, for example, to increases in the resistor's resistance, the source voltage will increase and the feed-forward current 82 will decrease.

In contrast, the feedback current 84 of the sensor will increase so that changes in the feed-forward current are substantially offset by changes in the feedback current. As a result, the sum current 84 and the output voltage remain substantially constant. Essentially, the feed-forward current 82 is a reference that may include an error term and the feedback current 84 includes a correction term that offsets the error to stabilize the sum current 85. A further operational description of the reference system 80 is enhanced by preceding it with the following examination of temperature dependance in MOS transistors.

FIG. 4A illustrates an exemplary diode-connected NMOSFET 112 that has a drain-to-source current $I_{DS}$ and a drain-to-source voltage $V_{DS}$ that equals its gate-to-source voltage $V_{GS}$. In this configuration, the transistor 112 is always operating in its saturation region. Assuming that narrow and short channel effects are avoided by fabricating the transistor 112 with channel width and length that are substantially greater than fabrication minimums, the relationship between $I_{DS}$ and $V_{GS}$ is given by $$I_{DS} = \frac{1}{2}\mu C_{ox}\frac{W}{L}(V_{GS} - V_t)^2 \tag{2}$$

which follows from equation (1) above. The square root of equation (2) is shown for three exemplary temperatures as plots 115, 116 and 117 in the graph 114 of FIG. 4B. Increasing temperature is indicated by a temperature arrow 118.

The plots 115, 116 and 117 exhibit a crossover point 119 at which $I_{DS}$ and $V_{GS}$ are substantially temperature insensitive. The current and voltage that correspond to the temperature insensitive crossover point 119 are accordingly labeled $I_{TI}$ and $V_{TI}$. It has been shown (e.g., see Tsividis, Yannis P., Operation and Modeling of the MOS Transistor, McGraw-Hill, Inc., 1987, New York, p. 148–149) that temperature variations in equation (2) are substantially produced by the temperature dependences of carrier mobility $\mu$ and threshold voltage $V_t$. These are respectively approximated as $$\mu(T) = \mu(T_r)\left(\frac{T}{T_r}\right)^{-k_3} \quad (3)$$

and $$V_t(T) = V_t(T_r) - k_4(T - T_r) \quad (4)$$

in which T is absolute temperature in degrees Kelvin, $T_r$ is room absolute temperature (300° K.), $\mu(T_r)$ is a constant, $k_3$ is approximately 1.5 and $k_4$ is approximately 2.3 m V/° K.

Equation (2) shows that device current $I_{DS}$ increases in response to increased mobility $\mu$ but decreases in response to increased threshold voltage $V_t$. As temperature increases, mobility $\mu$ and threshold voltage $V_t$ decrease in accordance with equations (3) and (4). At low device currents, the threshold voltage temperature dependence dominates and $I_{DS}$ increases with increased temperature as seen in the left side of FIG. 4B. At high device currents, in contrast, mobility temperature dependence dominates and $I_{DS}$ decreases with increased temperature as seen in the right side of FIG. 4B. The temperature insensitive current $I_{TI}$ defines the boundary between these opposite effects.

For each channel width-to-length ratio W/L, therefore, a corresponding device current $I_{TI}$ can be found that is temperature insensitive. Because of parameter differences (e.g., different carrier mobilities $\mu$), the W/L ratios corresponding to a given $I_{TI}$ will be different for p and n channel MOSFETs.

Returning attention now to the reference system 80 of FIG. 3, it is apparent from the above temperature-dependance description that a channel width-to-length ratio W/L can be selected for transistor 44 and subsequently, a value can be selected for resistor 42 that will obtain, for that W/L ratio, a device voltage and current that correspond to the temperature insensitive crossover point 119 of FIG. 4B. Because transistors 44 and 99 have the same gate-to-source voltage $V_{GS}$, a sense current 120 through the transistor 99 can also be made insensitive to temperature by configuring transistor 99 with the same channel width-to-length ratio W/L of transistor 44.

Transistors 44 and 99 will now operate at the same operating point so that the currents 64, 66 and 120 are substantially equal. Accordingly, a channel width-to-length ratio W/L can be selected for transistors 46, 49 and 102 that causes them to operate at a temperature insensitive crossover point (similar to point 119 in FIG. 4B). Because they are P-type devices, their channel width-to-length ratio W/L will generally not be the same as that of the N-type devices 44 and 99.

In accordance with the teachings of the invention, transistors 98 and 104 are respectively configured with first and second channel width-to-length ratios W/L that are first and second portions of the channel width-to-length ratio W/L of transistors 46, 49 and 102 wherein the first and second portions add substantially to one. The portions, however, need not be equal. As a first example, the first and second portions could be 40% and 60%. As a second example, the first and second portions could be 50% and 50%. Accordingly, the feed-forward current 82 and the feedback current 84 will also be the same first and second portions of the currents 64, 66 and 120 and the sum current 85 will then be substantially equal to these latter currents.

The temperature insensitivity of the invention will still be enhanced if the summer transistor 106 operates in the region of the temperature insensitive crossover point (119 of FIG. 4B) rather than precisely at that point, i.e., the portions need not add precisely to one. When practicing the invention, therefore, the first and second portions need not be equal but they preferably add to a number n wherein 0.1<n<10 and, more preferably, wherein 0.5<n<2.

If the channel width-to-length ratio W/L of the summer transistor 106 is then set equal to that of transistors 44 and 99, the transistor 106 also operates at a temperature insensitive crossover point. Finally, a channel width-to-length ratio W/L (typically ½ that of the ratio of transistors 46, 49 and 102) can be selected for transistors 98 and 104 that causes them to also operate at a temperature insensitive crossover point.

With the channel width-to-length ratio W/L selections described above, the sum transistor 106 operates at a temperature insensitive crossover point and the source voltage at the output port 86 is substantially temperature insensitive.

Teachings of the invention have been described for selecting channel width-to-length ratios in the reference system 80 of FIG. 3. These teachings can also be applied to the reference 40 of FIG. 2 to cause the transistors 44, 46, 49 and 50 to operate at temperature insensitive crossover points. If the resistance of resistor 42 is sensitive to temperature, however, the currents 64, 66 and 70 of the reference 40 will be shifted away from these temperature insensitive points. Accordingly, the current 70 and the voltage at the output port 54 will display temperature variations.

Typical resistors that are formed in CMOS fabrication processes include thin-film resistors (e.g., nichrome, tantalum and cermet), polysilicon resistors and diffused resistors. All of these resistor structures do indeed exhibit temperature sensitivity and, in particular, they generally exhibit positive temperature coefficients.

Figure 1:
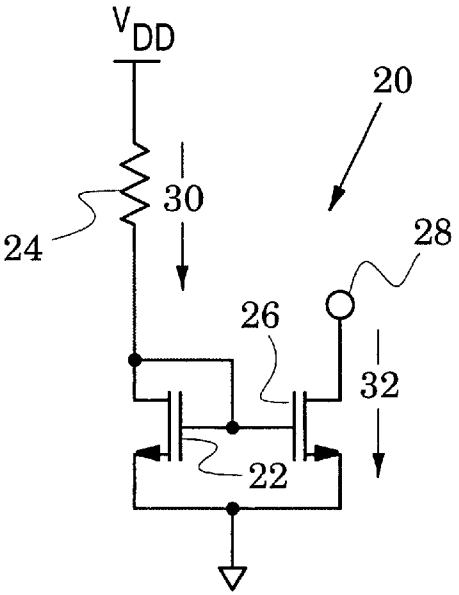
FIG. 1 (PRIOR ART)
FIG. 1 is a schematic diagram of a conventional current mirror.
Figure 2:
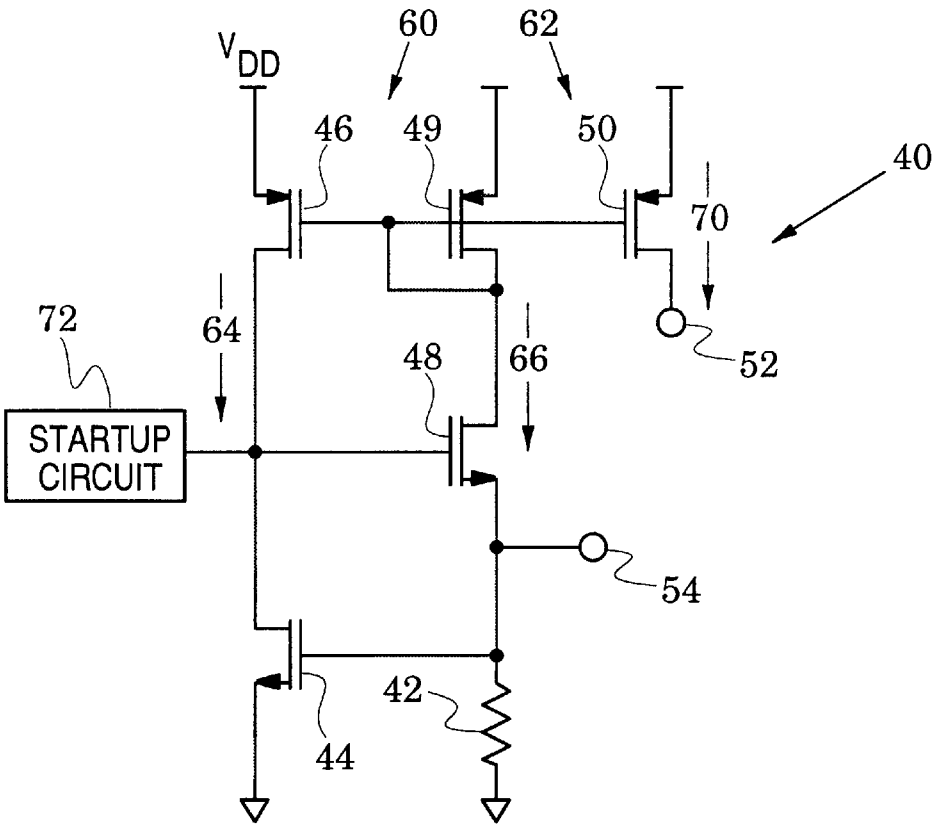
FIG. 2 (PRIOR ART)
FIG. 2 is a schematic diagram of a conventional $V_t$-referenced source.

In contrast to the reference 40 of FIG. 2, the operating points of transistors of the reference 80 of FIG. 3 will not be significantly disturbed by temperature changes in the resistor 42. As previously stated, a resistance increase results in a decrease in the feed-forward current 82 and an offsetting increase in the feedback current 84 so that the summer transistor 106 continues to operate at its temperature insensitive crossover point.

In more detail, the current mirror 60 urges currents 64 and 66 to be equal while the feedback circuit of transistors 44 and 48 and the resistor 42 requires the current 66 to be a function of the reference current 64. These circuits settle at an operating current that satisfies both conditions. After temperature changes cause a resistance increase in the resistor 42, the current mirror 60 will still urge equality of currents 64 and 66 but there will be a general decrease in the functional expression for the current 66.

The reference source 92, therefore, settles at a new operating point in which the voltage across resistor 42 has increased and the currents 64, 66 and 82 have decreased. In response to the voltage increase, the transistor 99 causes an increase in the feedback current 84 that opposes the decrease in the feed-forward current 82. Accordingly, the sum current 85 through the output transistor 106 remains essentially at its temperature insensitive crossover point.

In general, the $V_t$-referenced source 92 generates a source voltage and a feed-forward current 82 that has a first response to changes in the source voltage, the sensor 94 generates a feedback current 84 that has a second response to the changes that substantially offsets the first response; and the summer 96 sums the feed-forward current and the feedback current into a sum current 85 and generates a reference voltage 86 that is responsive to the sum current.

The reference system 90 is obtained by gate-coupling the transistors 88 and 106. The system 90 can be configured for use as a reference current or for use as a reference resistance. FIG. 5 is a graph 140 that illustrates the drain current of current transistor 88 as a function of its drain-to-source voltage. Generally, a transistor would operate along a plurality of drain current curves 142 that each correspond to a different gate-to-source voltage. However, the system 80 provides a temperature insensitive bias to the gate of transistor 88. Accordingly, the transistor 88 will operate only along one curve, e.g., the exemplary curve 144 in FIG. 5.

If the drain-to-source bias $V_{DS}$ of current transistor 88 is increased sufficiently, the transistor operates in its saturation region that is generally indicated by the arrow 146. The flatness of the drain current in this region indicates that the current transistor 88 functions as a high-impedance current source.

If the drain-to-source bias $V_{DS}$ is sufficiently decreased, the transistor operates in its triode region that is generally indicated by the arrow 148. Two exemplary lines 150 and 152 are drawn to be respectively tangent to drain curves 142 and 145 at respective tangent points 154 and 156 in the triode region. These tangent lines have different slopes that are indicative of the resistances that the current transistor 88 exhibits when biased at these tangent points. Because the current transistor 88 operates at a temperature insensitive crossover point, its $V_{DS}$ versus $I_{DS}$ transfer function is substantially insensitive to temperature, supply voltages and tracks fabrication processes.

The transistor 48 of FIG. 3 cooperates with transistor 44 and resistor 42 in a feedback operation that establishes currents 64 and 66 under an equality restraint that is set by the current mirror 60. Because the operating current and voltage of transistor 48 is thus automatically adjusted by the feedback operation, the channel width-to-length ratio W/L of this transistor need not be selected for temperature insensitivity. It can, instead, be selected to enhance other characteristics of the reference 80. For example, the channel length of transistor 48 can be set close to a fabrication minimum to reduce this transistor's drain-to-source voltage $V_{DS}$ and, thereby, permit the use of lower values of the supply voltage $V_{DD}$. This advantageously reduces the system's power consumption.

Figure 6:
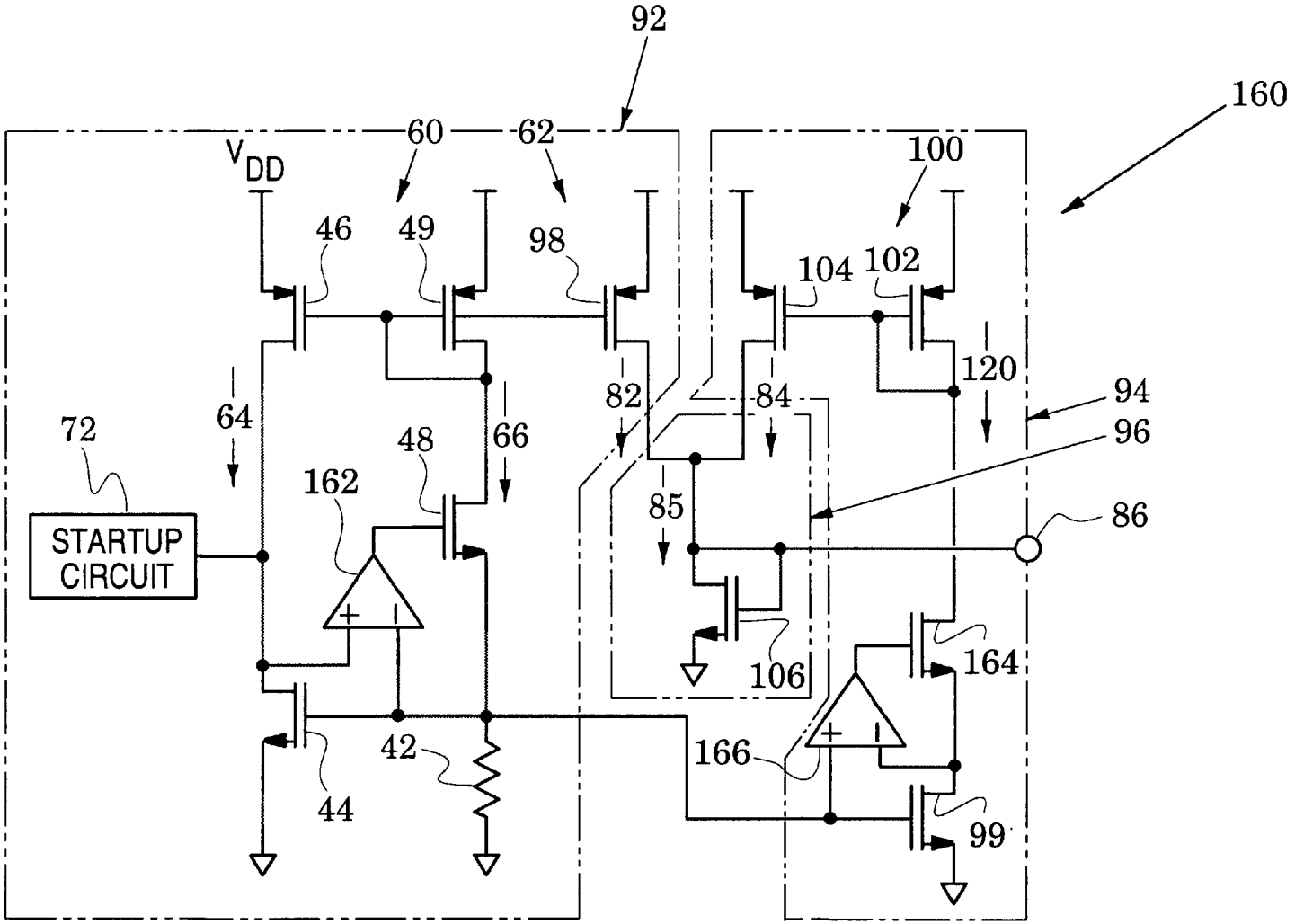
FIG. 6 is a schematic diagram of another reference system of the present invention.

In the reference system 80 of FIG. 3, transistors 44 and 99 are respectively involved in the generation of the feed-forward current 82 and the feedback current 84. They operate with the same gate-to-source voltage but their drain-to-source voltages $V_{DS}$ will change in response to circuit variations (e.g., temperature-induced variations). The insensitivity of the system would be further enhanced if these variations were reduced. Accordingly, the reference system 160 of FIG. 6 acts to stabilize these drain-to-source voltages.

The system 160 is similar to the system 80 of FIG. 3 with like elements indicated by like reference numbers. In contrast to the system 80, however, the source 92 has been modified with a differential amplifier 162 that is arranged with its input coupled across the drain and gate of transistor 44 and the drive of the gate of transistor 48 supplied by the output of the differential amplifier 162. Because the output voltage is in the region of a few volts and the amplifier has a high differential gain, the voltage between the drain-to-gate voltage of the transistor 44 is essentially reduced to zero. Thus, the transistor 44 is placed in a "virtual" diode-connected mode and its drain-to-gate voltage is stabilized over all operating conditions.

In a similar manner, the sensor 94 has been modified to stabilize the drain-to-gate voltage of sense transistor 99 by positioning a coupling transistor 164 between the transistor 99 and the current mirror 100 and by arranging a differential amplifier 166 with its input coupled across the drain and gate of transistor 99 and its output connected to the gate of the coupling transistor 164.

As described above, the reference system embodiment of FIG. 3 configured transistors 98 and 104 to operate at first and second portions of the current of transistors 49 and 102 that were selected so that the feed-forward and feedback currents 82 and 84 add to a sum current 85 that is substantially equal to the current that flows through each of transistors 49 and 102. The first and second portions are designed to add to one (or to a number n as defined above) but need not equal each other. Accordingly the term "mirror" is used herein to refer to the action of current mirrors but does not infer a one-to-one ratio between a reference and a mirrored current.

The teachings of the invention, however, may be practiced with different portions and the channel width-to-length ratios W/L of transistors 98, 104 and 106 appropriately readjusted so that they operate at temperature insensitive crossover points.

Although they have been illustrated with reference to exemplary types of MOSFETs and exemplary polarities of power supplies, the teachings of the invention can obviously be practiced with different reference systems that substitute different types and polarities.

The preferred embodiments of the invention described herein are exemplary and numerous modifications, dimensional variations and rearrangements can be readily envisioned to achieve substantially equivalent results, all of which are intended to be embraced within the scope of the appended claims.

We claim:

1. A voltage reference system, comprising:

a Vt-referenced source that generates a source voltage and a feed-forward current that has a first response to changes in said source voltage;

a sensor which generates a feedback current that has a second response to said changes that substantially offsets said first response; and a summer that sums said feed-forward current and said feedback current to form a larger sum current and conducts said sum current to generate a reference voltage;

changes in said feed-forward current are offset by changes in said feedback current and, accordingly, said sum current and said reference voltage remain substantially constant.

2. The system of claim 1, wherein said $V_t$-referenced source includes:

a first metal-oxide field-effect transistor;

a resistor coupled between the gate and source of said first transistor;

a second metal-oxide field-effect transistor having its gate and source respectively coupled to the drain and gate of said first transistor;

a current mirror coupled to the drains of said first and second transistors; and a third metal-oxide field-effect transistor coupled to mirror said current mirror and generate said feed-forward current with said source voltage being generated across said resistor.

3. The system of claim 1, wherein said sensor includes:

a sense transistor that generates a sense current in response to said source voltage; and a current mirror coupled to generate said feedback current by mirroring said sense current.

4. A voltage reference system, comprising:

a Vt-referenced source that generates a source voltage and a feed-forward current that has a first response to changes in said source voltage;

a sensor which generates a feedback current that has a second response to said changes that substantially offsets said first response; and a summer that sums said feed-forward current and said feedback current into a sum current and generates a reference voltage that is responsive to said sum current;

wherein said sensor includes:

a sense transistor that generates a sense current in response to said source voltage; and a current mirror coupled to generate said feedback current by mirroring said sense current;

changes in said feed-forward current thus corrected by changes in said feedback current so that said sum current and said reference voltage are substantially constant.

5. The system of claim 4, wherein said Vt-referenced source includes:

a first metal-oxide field-effect transistor;

a resistor coupled between the gate and source of said first transistor;

a second metal-oxide field-effect transistor that has its source coupled to the gate of said first transistor;

a differential amplifier that has an input coupled across the drain and gate of said first transistor and that has an output coupled to the gate of said second transistor;

a current mirror coupled to the drains of said first and second transistors; and a third metal-oxide field-effect transistor coupled to mirror said current mirror and generate said feed-forward current with said source voltage being generated across said resistor.

6. A voltage reference system, comprising:

a Vt-referenced source that generates a source voltage and a feed-forward current that has a first response to changes in said source voltage;

a sensor which generates a feedback current that has a second response to said changes that substantially offsets said first response; and a summer that sums said feed-forward current and said feedback current into a sum current and generates a reference voltage that is responsive to said sum current;

wherein said sensor includes:

a sense transistor that generates a sense current in response to said source voltage;

a current mirror;

a coupling metal-oxide field-effect transistor coupled between said sense transistor and said current mirror; and a differential amplifier that has an input coupled across the drain and gate of said sense transistor and that has an output coupled to the gate of said coupling transistor;

said current mirror thereby generating said feedback current by mirroring said sense current;

changes in said feed-forward current thus corrected by changes in said feedback current so that said sum current and said reference voltage are substantially constant.

7. The system of claim 6, wherein said summer comprises a diode-coupled metal-oxide field-effect transistor.

8. A voltage reference system, comprising:

a Vt-referenced source that generates a source voltage and a feed-forward current that has a first response to changes in said source voltage;

a sensor which generates a feedback current that has a second response to said changes that substantially offsets said first response; and a summer that sums said feed-forward current and said feedback current into a sum current and generates a reference voltage that is responsive to said sum current;

changes in said feed-forward current thus corrected by changes in said feedback current so that said sum current and said reference voltage are substantially constant;

wherein said Vt-referenced source includes:

a) a first metal-oxide field-effect transistor;

b) a resistor coupled between the gate and source of said first transistor;

c) a second metal-oxide field-effect transistor having its gate and source respectively coupled to the drain and gate of said first transistor;

d) a first current mirror coupled to the drains of said first and second transistors; and e) a third metal-oxide field-effect transistor coupled to mirror said current mirror and generate said feed-forward current with said source voltage being generated across said resistor; said sensor includes:

a) a sense transistor that generates a sense current in response to said source voltage; and b) a second current mirror coupled to generate said feedback current by mirroring said sense current;

and said summer comprises a first diode-coupled metal-oxide field-effect transistor.

9. The system of claim 8, wherein said first, sense and first diode-coupled transistors have substantially the same channel width-to-length ratio.

10. The system of claim 8, wherein:

said first current mirror includes a second diode-coupled transistor and a fourth metal-oxide field-effect transistor that is gate-coupled to said second diode-coupled transistor;

said second current mirror includes a third diode-coupled transistor and a fifth metal-oxide field-effect transistor that is gate-coupled to said third diode-coupled transistor;

said second and third diode-coupled transistors and said fourth transistor have a first channel width-to-length ratio; and said third and fifth transistors have second and third channel width-to-length ratios that are first and second portions of said first channel width-to-length ratio wherein said first and second portions add to n and $0.1<n<10$.

11. A current reference system, comprising:

a Vt-referenced source that generates a source voltage and a feed-forward current that has a first response to changes in said source voltage;

a sensor which generates a feedback current that has a second response to said changes that substantially offsets said first response;

a summer that sums said feed-forward current and said feedback current to form a larger sum current and conducts said sum current to generate a reference voltage; and a current transistor that is biased in its saturation region to generate a reference current in response to said reference voltage;

changes in said feed-forward current are offset by changes in said feedback current and, accordingly, said sum current, said reference voltage and said reference current remain substantially constant.

12. The system of claim 11, wherein said $V_t$-referenced source includes:

a first metal-oxide field-effect transistor;

a resistor coupled between the gate and source of said first transistor;

a second metal-oxide field-effect transistor having its gate and source respectively coupled to the drain and gate of said first transistor;

a current mirror coupled to the drains of said first and second transistors; and a third metal-oxide field-effect transistor coupled to mirror said current mirror and generate said feed-forward current with said source voltage being generated across said resistor.

13. The system of claim 11, wherein said sensor includes:

a sense transistor that generates a sense current in response to said source voltage; and a current mirror coupled to generate said feedback current by mirroring said sense current.

14. A current reference system, comprising:

a Vt-referenced source that generates a source voltage and a feed-forward current that has a first response to changes in said source voltage;

a sensor which generates a feedback current that has a second response to said changes that substantially offsets said first response;

a summer that sums said feed-forward current and said feedback current into a sum current and generates a reference voltage that is responsive to said sum current; and a current transistor that is biased in its saturation region to generate a reference current in response to said reference voltage;

changes in said feed-forward current thus corrected by changes in said feedback current so that said sum current, said reference voltage and said reference current are substantially constant;

wherein said sensor includes:

a sense transistor that generates a sense current in response to said source voltage; and a current mirror coupled to generate said feedback current by mirroring said sense current.

15. The system of claim 14, wherein said summer is a diode-coupled metal-oxide field-effect transistor and said current transistor is a metal-oxide field-effect transistor that is gate-coupled to said diode-coupled transistor.

16. A current reference system, comprising:

a Vt-referenced source that generates a source voltage and a feed-forward current that has a first response to changes in said source voltage;

a sensor which generates a feedback current that has a second response to said changes that substantially offsets said first response;

a summer that sums said feed-forward current and said feedback current into a sum current and generates a reference voltage that is responsive to said sum current; and a current transistor that is biased in its saturation region to generate a reference current in response to said reference voltage;

changes in said feed-forward current thus corrected by changes in said feedback current so that said sum current, said reference voltage and said reference current are substantially constant;

wherein said Vt-referenced source includes:

a) a first metal-oxide field-effect transistor;

b) a resistor coupled between the gate and source of said first transistor;

c) a second metal-oxide field-effect transistor having its gate and source respectively coupled to the drain and gate of said first transistor;

d) a first current mirror coupled to the drains of said first and second transistors; and e) a third metal-oxide field-effect transistor coupled to mirror said current mirror and generate said feed-forward current with said source voltage being generated across said resistor;

said sensor includes:

a) a sense transistor that generates a sense current in response to said source voltage; and b) a second current mirror coupled to generate said feedback current by mirroring said sense current;

said summer comprises a first diode-coupled metal-oxide field-effect transistor; and said current transistor is a current metal-oxide field-effect transistor that is gate-coupled to said first diode-coupled transistor.

17. The system of claim 16, wherein said first, sense, current and first diode-coupled transistors have substantially the same channel width-to-length ratio.

18. The system of claim 16, wherein:

said first current mirror includes a second diode-coupled transistor and a fourth metal-oxide field-effect transistor that is gate-coupled to said second diode-coupled transistor;

said second current mirror includes a third diode-coupled transistor and a fifth metal-oxide field-effect transistor that is gate-coupled to said third diode-coupled transistor;

said second and third diode-coupled transistors and said fourth transistor have a first channel width-to-length ratio; and said third and fifth transistors have second and third channel width-to-length ratios that are first and second portions of said first channel width-to-length ratio wherein said first and second portions add to n and $0.1<n<10$.

19. A resistance reference system, comprising:

a Vt-referenced source that generates a source voltage and a feed-forward current that has a first response to changes in said source voltage;

a sensor which generates a feedback current that has a second response to said changes that substantially offsets said first response;

a summer that sums said feed-forward current and said feedback current to form a larger sum current and conducts said sum current to generate a reference voltage; and an output transistor that is biased in its triode region to generate a reference resistance in response to said reference voltage;

changes in said feed-forward current are offset by changes in said feedback current and, accordingly, said sum current, said reference voltage and said reference resistance remain substantially constant.

20. The system of claim 19, wherein said $V_t$-referenced source includes:

a first metal-oxide field-effect transistor;

a resistor coupled between the gate and source of said first transistor;

a second metal-oxide field-effect transistor having its gate and source respectively coupled to the drain and gate of said first transistor;

a current mirror coupled to the drains of said first and second transistors; and a third metal-oxide field-effect transistor coupled to mirror said current mirror and generate said feed-forward current with said source voltage being generated across said resistor.

21. The system of claim 19, wherein said sensor includes:

a sense transistor that generates a sense current in response to said source voltage; and a current mirror coupled to generate said feedback current by mirroring said sense current.

22. A resistance reference system, comprising:

a Vt-referenced source that generates a source voltage and a feed-forward current that has a first response to changes in said source voltage;

a sensor which generates a feedback current that has a second response to said changes that substantially offsets said first response;

a summer that sums said feed-forward current and said feedback current into a sum current and generates a reference voltage that is responsive to said sum current; and an output transistor that is biased in its triode region to generate a reference resistance in response to said reference voltage;

changes in said feed-forward current thus corrected by changes in said feedback current so that said sum current, said reference voltage and said reference resistance are substantially constant;

wherein said sensor includes:

a sense transistor that generates a sense current in response to said source voltage; and a current mirror coupled to generate said feedback current by mirroring said sense current.

23. The system of claim 22, wherein said summer is a diode-coupled metal-oxide field-effect transistor and said output transistor is a metal-oxide field-effect transistor that is gate-coupled to said diode-coupled transistor.

* * * * *